United States Patent [19]

Matsumoto et al.

[11] 4,385,512

[45] May 31, 1983

[54] TANDEM ROLLING MILL TRAIN FOR METAL PLATE AND SHEET

[75] Inventors: Hiromi Matsumoto; Yuji Uehori, both of Kitakyushu; Tetsuo Kajihara; Tsuneo Nakano, both of Hiroshima, all of Japan

[73] Assignees: Nippon Steel Corporation; Mitsubishi Jukogyo Kabushiki Kaisha, both of Tokyo, Japan

[21] Appl. No.: 281,044

[22] Filed: Jul. 7, 1981

[30] Foreign Application Priority Data

Jul. 10, 1980 [JP] Japan ..... 55/93226

[51] Int. Cl.[3] ..... B21B 13/02

[52] U.S. Cl. ..... 72/234; 72/199; 72/366

[58] Field of Search ..... 72/199, 234, 235, 241, 72/243, 366

[56] References Cited

FOREIGN PATENT DOCUMENTS

| | | | |
|---|---|---|---|
| 52-19821 | 5/1977 | Japan . | |
| 53-1221 | 1/1978 | Japan . | |
| 53-76948 | 7/1978 | Japan . | |
| 55-64908 | 5/1980 | Japan . | |
| 55-128303 | 10/1980 | Japan | 72/241 |

*Primary Examiner*—Francis S. Husar
*Assistant Examiner*—Jonathan L. Scherer
*Attorney, Agent, or Firm*—Wenderoth, Lind & Ponack

[57] ABSTRACT

A tandem rolling mill train for rolling metal plate or sheet includes a plurality of crossed-roll type rolling mill stands. The work rolls on at least two of the crossed-roll type rolling mill stands are respectively slanted in opposite directions so that the widthwise shear deformation developed on the upstream crossed-roll type stand is reduced by the widthwise shear deformation caused on the downstream crossed-roll type stand.

4 Claims, 7 Drawing Figures

TANDEM ROLLING MILL TRAIN FOR METAL PLATE AND SHEET

BACKGROUND OF THE INVENTION

This invention relates to a tandem rolling mill train for metal plate and sheet, and more particularly to a tandem rolling mill train including a cross-roll type rolling mill stand.

The flatness or the cross-sectional shape of rolled plate or sheet (hereinafter called the strip) of steel and the like is sometimes impaired by the uneven elongation across its width.

One technique for controlling the widthwise thickness distribution during rolling employs rolling rolls curved by applying hydraulic force on the roll chocks thereof so that the profile of the roll gap through which the piece passes is varied. This technique is known as the roll bending method.

But this method can control the widthwise thickness distribution only to a limited extent since the bending of work rolls is restricted by backup rolls etc.

The technique disclosed in Japanese Patent Publication No. 19821 of 1977 and Japanese Patent Laid Open No. 64908 of 1980 offers a solution to this problem. This method may be termed crossed-roll rolling. It controls the thickness distribution across the width of the strip being rolled by changing the angle formed between the axis of the crossed work rolls and the direction of strip travel, within a plane parallel to the surface of the piece. A rolling mill based on this crossed-roll concept is disclosed, for example, in Japanese Patent Publication No. 1221 of 1978.

The top and bottom work rolls based on the cross-roll concept lie diagonally across the width of a strip 1. Because of this roll arrangement, as shown in FIG. 1, oppositely oriented shearing forces F work on the top and bottom surfaces of the strip 1 across the width thereof, so that the cross-sectional shape across the width of the strip 1, which is rectangular at the start, becomes parallelogramic after being rolled.

When the corners of the cross section of the strip 1 considerably deviate from 90 degrees, the edge 3 of an acute-angled corner 2 ($\alpha<90°$) must be trimmed off since such portion might get bent, thus becoming unsuited for shipment, during handling. Such trimming naturally lowers the production yield of strip. If a parallelogramic strip is passed through a subsequent processing line, the edge 3 of the acute-angled corner 2 might get damaged upon coming in contact with the guide of the line, possibly causing the breaking of the strip.

Thus, rolling on a crossed-roll mill involves various operational problems.

SUMMARY OF THE INVENTION

This invention is intended as a solution for the aforementioned problems encountered in rolling plate or sheet on a crossed-roll type rolling mill stand.

The object of this invention is to provide a tandem rolling mill train including a crossed-roll type rolling mill stand which rolls plate or sheet having substantially right-angled corners, free from widthwise shear deformation.

A tandem rolling mill train according to this invention includes a plurality of crossed-roll type rolling mill stands. The crossed work rolls on at least two of such stands are slanted in opposite directions, so that the widthwise shear deformation caused by the oppositely directed forces exerted on the top and bottom surfaces of the rolled piece on the upstream stand is offset by that caused on the downstream stand. This results in plate or sheet having substantially right-angled corners, preventing the yield reduction and damage due to the acute-angled edge.

DETAILED DESCRIPTION OF THE PREFERRED EMBODIMENTS

Figure 1:
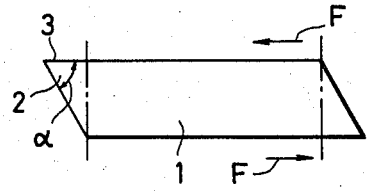
FIG. 1 PRIOR ART
FIG. 1 schematically illustrates the shear deformation caused in the cross section of a piece rolled on a crossed-roll type stand.
Figure 2:
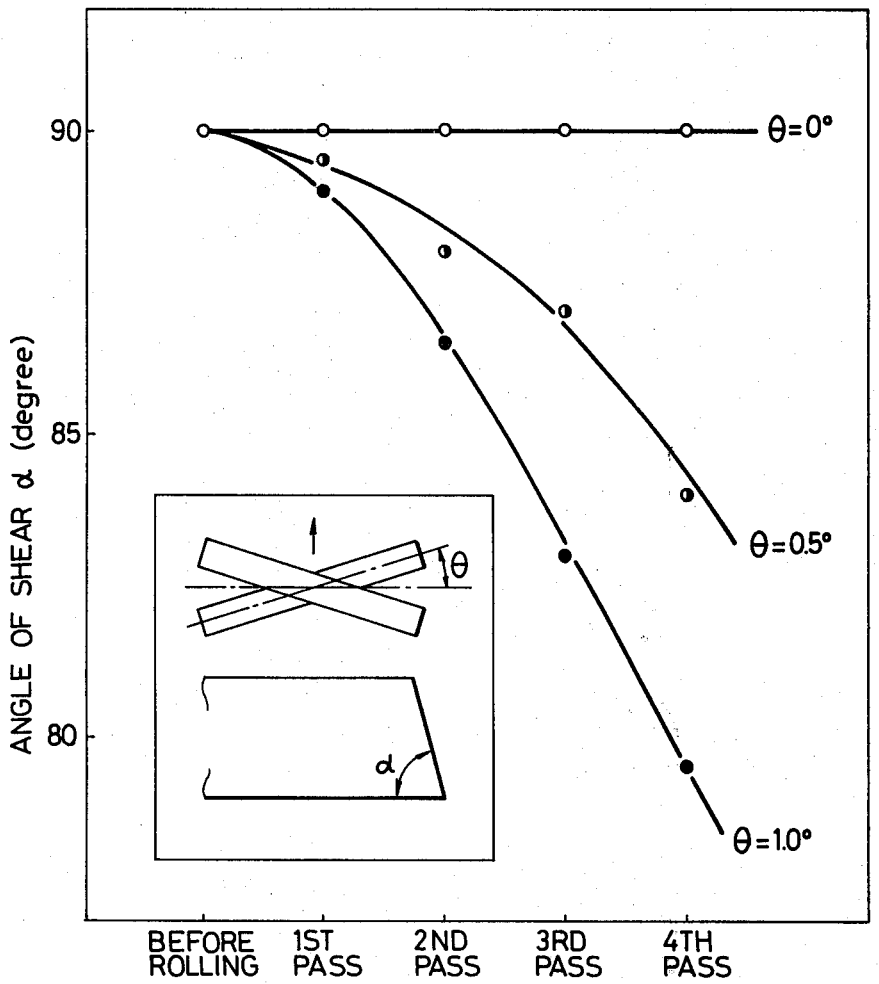
FIG. 2 shows the relationship between the shear deformation and the number of passes on the crossed-roll type stand, for different angles at which the work rolls of the stand are crossed.

The inventors determined the relationship among the angle of shear $\alpha$ at a corner of the widthwise cross section of a rolled piece, the angle $\theta$ at which the top and bottom work rolls of a crossed-roll type stand are crossed across the width of the piece, and the number of passes given to the piece, as shown in FIG. 2.

In FIG. 2, the number of passes is plotted on the abscissa and the angle $\alpha$ of the acute-angled corner of the cross section of strip on the ordinate. As evident from FIG. 2, the angle $\alpha$ grows smaller as the number of passes increases, for all angles at which the top and bottom work rolls are crossed.

As a result of studies, the inventors have reached a conclusion that this tendency can most rationally be corrected by offsetting the widthwise shear deformation caused by the oppositely directed forces exerted on the top and bottom surfaces of the rolled piece in one pass by causing an oppositely oriented deformation in the next pass.

For the rolling of steel and other metal plate or sheet, a rolling mill train, comprising a plurality of mill stands disposed in tandem, is used. To attain the object of this invention, the top and bottom work rolls on adjacent stands in a mill train are respectively slanted in opposite directions. The adjoining stands thus arranged provide oppositely oriented widthwise shear deformations to the cross section of the piece being rolled by exerting oppositely directed shearing forces on the top and bottom surfaces thereof, thereby avoiding the creation of acute-angled corners.

Figure 3:
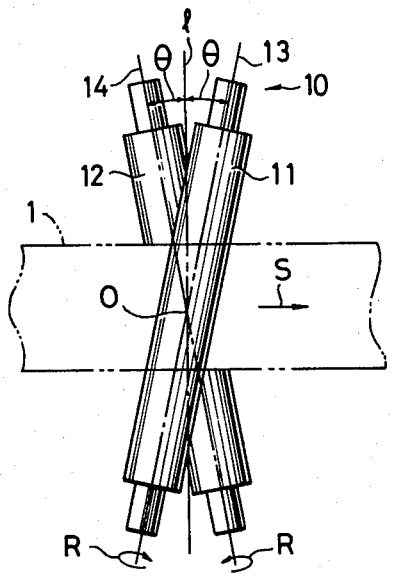
FIG. 3 is a schematic plan view of a crossed-roll type rolling mill stand.

FIG. 3 is a schematic plan view of a crossed-roll type rolling mill stand. As is the case with ordinary strip mill stands, the axes 13 and 14 of the top and bottom work rolls 11 and 12 of a crossed-roll type rolling mill stand 10 lie in planes that are parallel to the surface of the strip 1 being rolled, and vertically spaced from each other. But the roll axes 13 and 14 are crossed as illustrated. The intersecting point is substantially at the center O of the axes 13 and 14 of the work rolls 11 and 12. The roll axes 13 and 14 are slanted at an angle (hereinafter called the angle of intersection $\theta$) with respect to a straight line l that extends across the width of the strip, or perpendicular to the direction S in which the strip travels. The angle of intersection $\theta$ ranges, for example, between approximately 0 and 1.5 degrees, although it varies with the size of the strip 1, the reduction applied thereon, and other factors. The top and bottom work rolls 11 and 12 are slanted at the same angle of intersection $\theta$, and driven in opposite directions R.

Basically, the top and bottom work rolls are slanted at the same angle of intersection as described above. But where the control of strip meandering or other special effects are desired, the top and bottom work rolls may be set at different angles of intersection, as disclosed in Japanese Patent Laid Open No. 76948 of 1978. Even in such cases, this invention can be applied without difficulty.

The tandem rolling mill train as used in this specification means a plurality of rolling mill stands arranged in tandem through which a material piece is progressively reduced in one direction while traveling forward. According to this invention, the piece need not always be rolled at the same time on all of the stands that make up the mill train. When reversed rolling is conducted on a single stand on which the top and bottom rolls are crossed at a fixed angle, the shearing force in each pass works in a reversed direction, so that the effect of one pass is offset by the next pass, eliminating the problem which this invention is intended to overcome.

Figure 4:
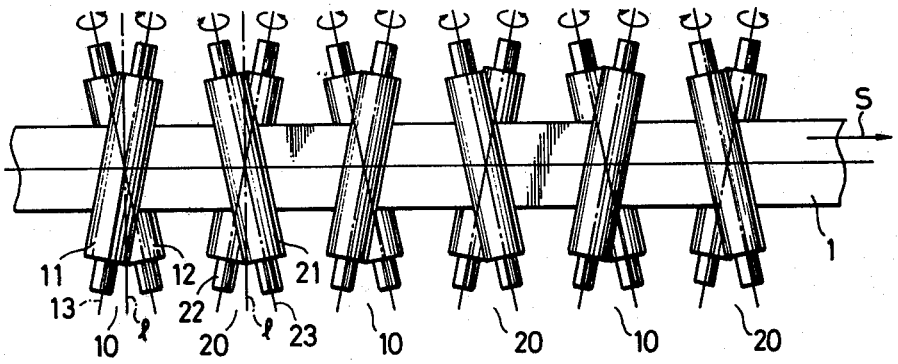
FIG. 4 is a schematic plan view of an embodiment of this invention, a rolling mill train the stands of which are all of the crossed-roll type.

FIG. 4 shows a first embodiment of this invention, which is a rolling mill train comprising six crossed-roll type mill stands arranged in tandem. In this mill train, the crossed-roll type stands 10 and 20 are disposed alternately. The axis 13 of the top work roll 11 on the stand 10 is aslant clockwise with respect to the straight line l, whereas the axis 23 of the top work roll 21 on the stand 20 is aslant counterclockwise. The top and bottom work rolls on the stands 10 and 20 are slanted in opposite directions.

In this mill train, the strip 1 undergoes a shear deformation, as a result of the shearing forces, working in opposite directions, exerted on the top and bottom surfaces thereof on the first stand 10. On the second stand 20, the strip undergoes a shear deformation which offsets the one that has taken place on the preceding stand. By repeating this cycle, the shear angle at the corners of the widthwise cross section of the strip 1 can be reduced to a minimum.

If a strip coming out of a crossed-roll type stand is next rolled on an ordinary stand the work rolls of which are not crossed but parallel, the shear angle at the corners developed on the former becomes more pronounced on the latter. It is therefore necessary to correct such shear angle, or make the deformed corners right-angled, as soon as possible. If carried over to a later stage, this correction would require many more passes than if done in an earlier stage. From this viewpoint, the mill train in FIG. 4 is ideal since all stands are of the crossed-roll type, with the top and bottom work rolls on adjacent stands being crossed in opposite directions.

Figure 5:
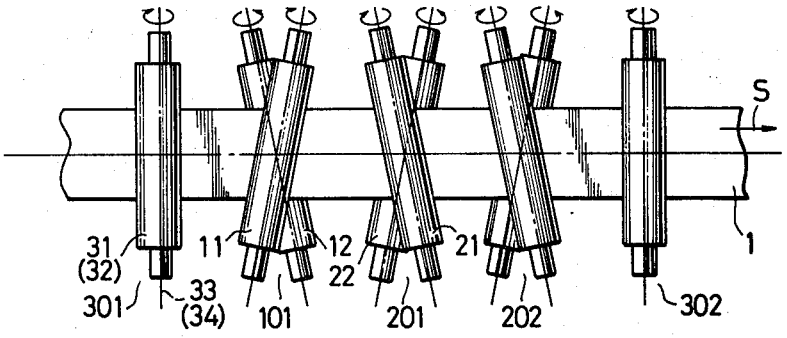
FIG. 5 is a schematic plan view of another embodiment of this invention, a rolling mill train with a plurality of crossed-mill type stands disposed between two ordinary stands.
Figure 6:
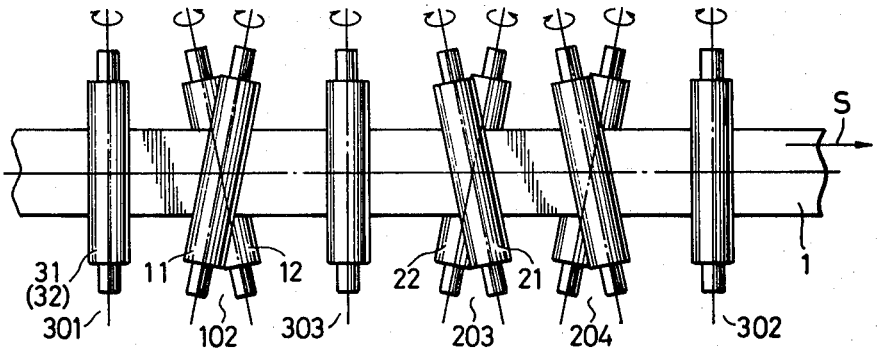
FIG. 6 is a schematic plan view of still another embodiment of this invention, a variation of the embodiment in FIG. 5 in which another ordinary stand is placed between the crossed-roll type stands.

Depending on rolling requirements and conditions, however, such ideal arrangement is not always possible, in which case, for example, the arrangements shown in FIGS. 5 and 6 are adopted.

FIG. 5 shows a second embodiment of this invention, in which the first and last rolling mill stands 301 and 302 in a mill line are of the ordinary type, with the axes 33 and 34 of the top and bottom work rolls 31 and 32 being parallel to each other and at right angles to the direction S in which the strip travels. Between the two ordinary stands 301 and 302 are disposed three crossed-roll type stands 101, 201 and 202, the five stands being arranged in tandem.

This mill train is suited for where, because of certain rolling conditions, a large angle of intersection is allowed only on the stand 101, but not on the stands 201 and 202. The angle of shear developed on the stand 101 is corrected on the following stands 201 and 202.

FIG. 6 shows a third embodiment of this invention. This is a variation of the embodiment of FIG. 5, in which an ordinary stand is disposed between the first two crossed-roll type stands.

This mill train is suited for where the need to obtain the desired strip crown and shape does not permit rolling on two successive crossed-roll type stands. The shear angle at the corner developed on the crossed-roll stand 102 is first made more pronounced by the rolling on the ordinary stand 303, but then corrected by the following two crossed-roll stands 203 and 204.

Figure 7:
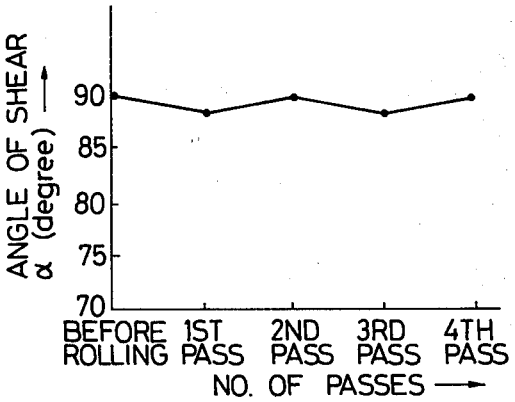
FIG. 7 shows the angle of shear at the corner of steel strip rolled on a rolling mill train according to this invention.

FIG. 7 shows a pass-to-pass change in the angle of shear $\alpha$ developed in the widthwise cross section of the strip rolled by a mill train according to this invention. In this mill train, four crossed-roll type stands are disposed in such a fashion that the work rolls on adjacent stands are slanted in opposite directions. As graphically shown in FIG. 7, the angle of shear $\alpha$ falls within the practically acceptable range of 88 to 90 degrees.

The aforementioned bend and damage of strip due to the angle of shear at the corner of the widthwise cross section thereof can be prevented by arranging a mill train in such a manner that the top and bottom work rolls on adjacent crossed-roll type stands are slanted in opposite directions.

The foregoing are the most favorable embodiments, but this invention is by no means limited thereto. The object of this invention can be achieved, in short, so long as any shear deformation developed on one or more rolling mill stands is offset by one or more subsequent crossed-roll type stands that give the oppositely directed shear deformation to the piece.

Thanks to the above-described construction and operation, the tandem rolling mill train according to this ensures an efficient, high-yield crossed-roll type rolling, free from the otherwise unavoidable shear deformation in the widthwise cross section of the rolled piece.

What is claimed is:

1. In a tandem rolling mill train for rolling metal plate or sheet which comprises a plurality of crossed-roll type rolling mill stands each having a top and bottom work roll the axes of which lie in planes parallel to the surface of the piece being rolled and crossing substantially at the center thereof, the improvement which comprises at least two crossed-roll type rolling mill stands, the work rolls on one stand being respectively slanted in directions opposite to those on the other stand so that the widthwise shear deformation developed on the upstream stand is reduced by the widthwise shear deformation on the downstream stand.

2. The improvement according to claim 1, in which the rolling mill stands incorporated are all of the crossed-roll type, the work rolls on adjacent stands being slanted in directions opposite to each other.

3. The improvement according to claim 1, in which one ordinary stand procedes and follows a plurality of crossed-roll type stands disposed in tandem.

4. The improvement according to claim 1, in which one ordinary stand is disposed before, behind and midway in a plurality of crossed-roll type stands arranged in tandem.

* * * * *